US005695355A

United States Patent [19]

Hasenfratz et al.

[11] Patent Number: 5,695,355

[45] Date of Patent: Dec. 9, 1997

[54] LOCKING DEVICE FOR A CONNECTOR

[75] Inventors: Robert Hasenfratz, Waiblingen; Martin Gollhofer, Fellbach; Manfred Illg, Weinstadt; Werner Pfitzenreiter, Lorch, all of Germany

[73] Assignee: ITT Cannon GmbH, Weinstadt, Germany

[21] Appl. No.: 576,275

[22] Filed: Dec. 21, 1995

[30] Foreign Application Priority Data

Jan. 4, 1995 [DE] Germany ..... 195 00 102.8

[51] Int. Cl.[6] ..... H01R 13/627

[52] U.S. Cl. ..... 439/357; 439/353

[58] Field of Search ..... 439/345, 347, 439/350, 351, 352, 353, 354, 357, 358, 355, 356

[56] References Cited

U.S. PATENT DOCUMENTS

| | | | |
|---|---|---|---|
| 3,566,336 | 2/1971 | Johnson et al. | 439/353 |
| 4,032,209 | 6/1977 | Rutkowski | 439/355 |
| 5,486,117 | 1/1996 | Chang | 439/357 |

FOREIGN PATENT DOCUMENTS

| | | |
|---|---|---|
| 1099611 | 2/1961 | Germany . |
| 1109238 | 6/1961 | Germany . |
| 1878851 | 11/1962 | Germany . |
| 1234285 | 2/1967 | Germany . |
| 2422313 | 5/1974 | Germany . |

*Primary Examiner*—Hien Vu

*Attorney, Agent, or Firm*—Leon D. Rosen; Freilich, Hornbaker & Rosen

[57] ABSTRACT

A locking device is provided for an electrical connector system to hold two connectors, (1, 2) together. The locking device includes S-shaped sheet metal locking hooks (9) on a second connector that lock into cutouts (8) on a plate (7) of the first connector. One curved arch (14) of the S-shaped sheet metal hook snaps into the cutout and resists unmating.

3 Claims, 3 Drawing Sheets

LOCKING DEVICE FOR A CONNECTOR

The invention relates to a locking device for a connector, having a plug part and a mating component accepting this plug part, the mating component having at least one cutout and the plug part having at least one locking hook, or vice versa, the locking hook, furthermore, consisting essentially of a preferably, at least approximately, flat basic element, as well as a spring element manufactured in one piece with said basic element, the spring element having an arched section engaging the cutout. Such locking devices for connectors are already known. They are used for rapidly and securely connecting the two parts of this connector. The locking device engages automatically if the two halves of the connector are pushed far enough into one another. The connection accepts tensile forces up to a predetermined value. If this value is exceeded, disengagement is automatic and the connector halves can then be separated from one another again in this way. Accordingly, the locking connection of this connector consists of at least one window-type cutout and an associated locking element formed by the locking hook. Consequently, the locking hook projects laterally to the plane of the basic element, so that with the basic element in contact with the mating component, the spring element engages the cutout as soon as both items are appropriately aligned when the connector halves are pushed into each other far enough. Prior to this engagement, the spring element is elastically deflected in a direction away from the mating component.

As with all parts in the art, such connector halves are manufactured with a certain tolerance range. Now, if the pair of tolerances is unfavourable, the retaining force of the connector is less than would be the case with a more favourable tolerance situation. Consequently, the retaining forces vary with repeated forcible unlocking, down to a value of zero. Incidentally, damage to the connector by forcible release cannot be ruled out. The main reason is that the arched section of the locking hook of the known locking device is rigid and the elasticity prior to engagement comes exclusively from the basic element.

Consequently, the technical problem of the invention is to develop a locking device of the type referred to above, so that the stated disadvantages are avoided and the elastic characteristic of the locking hook is improved, so that a longer service life is obtained not only for the locking hook but for the entire connector as well.

To solve this problem according to the invention, it is proposed that the locking device stated in the preamble of claim 1 features a second arched area which is inserted between the arched area of the spring element and the point where it connects with the basic element, the arched areas together forming an approximately S-shaped element, and the two arcs projecting in opposing directions beyond the face or plane of the basic element.

Elasticity of the spring element is achieved in this manner, so that the overall elasticity is no longer due to the basic element alone. The second arched area produces free forming of the supporting shoulder, which together with the spring elasticity of the spring element now obtained, relieves the highly-stressed connection point between the spring element and the basic element, thereby considerably reducing the risk of fracture. Moreover, reliable and complete contact between the spring element and the cutout, and over the length of the cutout, is achieved.

All this leads to constant retaining forces, even with a diagonal pull. With an uncontrolled pull on the cable the cable connector is released without damaging a connector component. The production tolerances can now be increased, which reduces the cost of the connector. Varying the support angle produces adjustable forces.

Advantageously, the transition region between the first and second arched area runs more or less perpendicular to the plane of the mating component in the area of the cutout. Furthermore, for reasons of loading capacity and long service life, it is very useful if the second arched area of the spring element merges into a type of groove in the basic element, i.e. a corner or edge is avoided in this region and an arc is provided instead.

According to a further development of the invention, a flat end piece, that is preferably placed in the plane of the basic element, adjoins the free end of the first arched area of the spring element. This applies when the locking device is opened.

According to a further development of the invention, the width of the flat end piece is less than the width of the rest of the spring element and the transition is in the form of a step on both sides. Moreover, it is very advantageous that the basic element has an approximate U-shape, and the spring element is formed at the U-shaped centre web of the basic element. The basic element provides anchorage in the relevant part of the connector, that is for example in the mating component where there is a slot, preferably with an open edge, corresponding to the thickness of the basic element, into which the locking hook is inserted, for example, laterally to the direction of connection of the two parts of the connector.

The locking hook is held in a clamping manner in the slot. can if necessary be additionally secured with conventional means. The locking hook can be a punched and bent part which can usefully be produced from spring steel blate.

The invention is explained in further detail below with the aid of the drawing. The drawing shows an exemplary embodiment of the invention in which.

Figure 1:
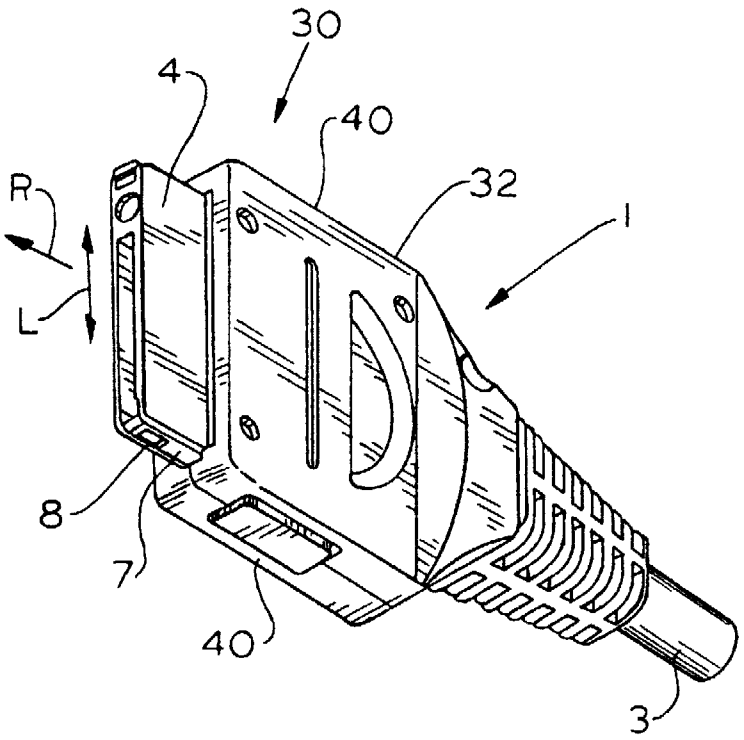
FIG. 1 is a perspective view of a plug part of the connector.
Figure 2:
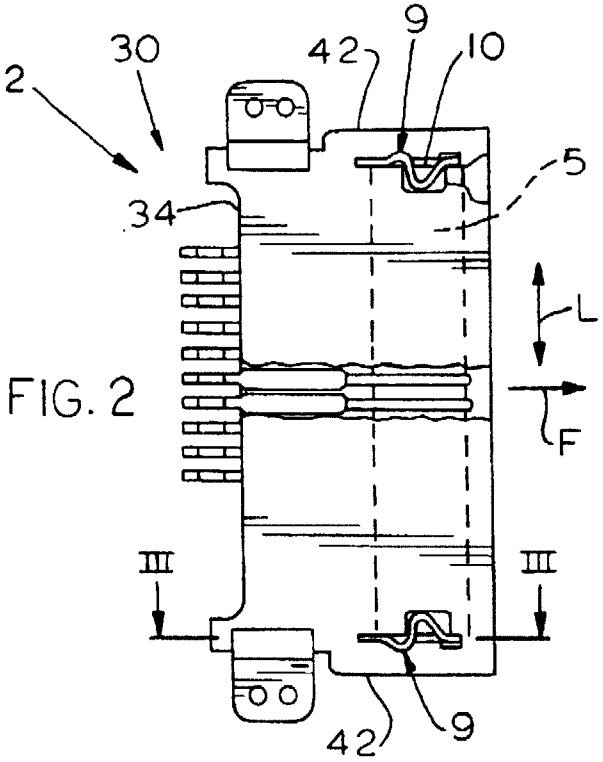
FIG. 2 is a plan view of the associated mating component of the connector.
Figure 3:
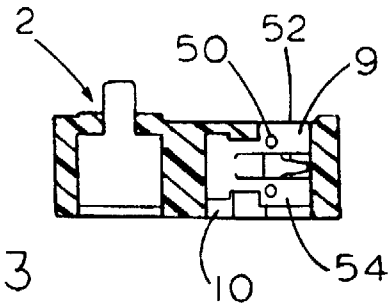
FIG. 3 is a sectional view along the line III—III of FIG. 2.
Figure 5:
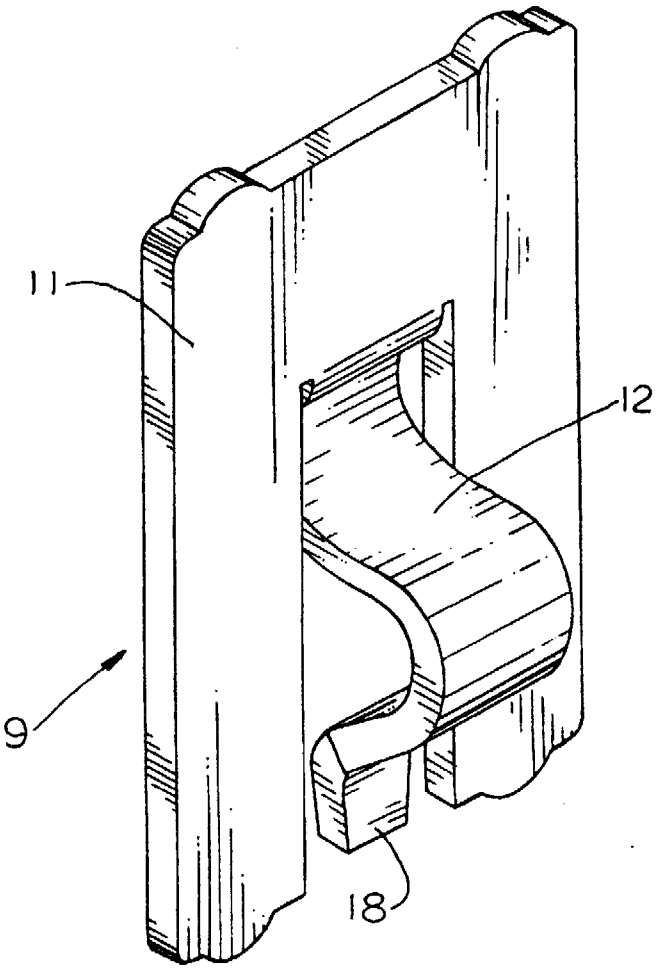
FIGS. 4 and 5 are two very enlarged perspective views of the locking hook.
Figure 4:
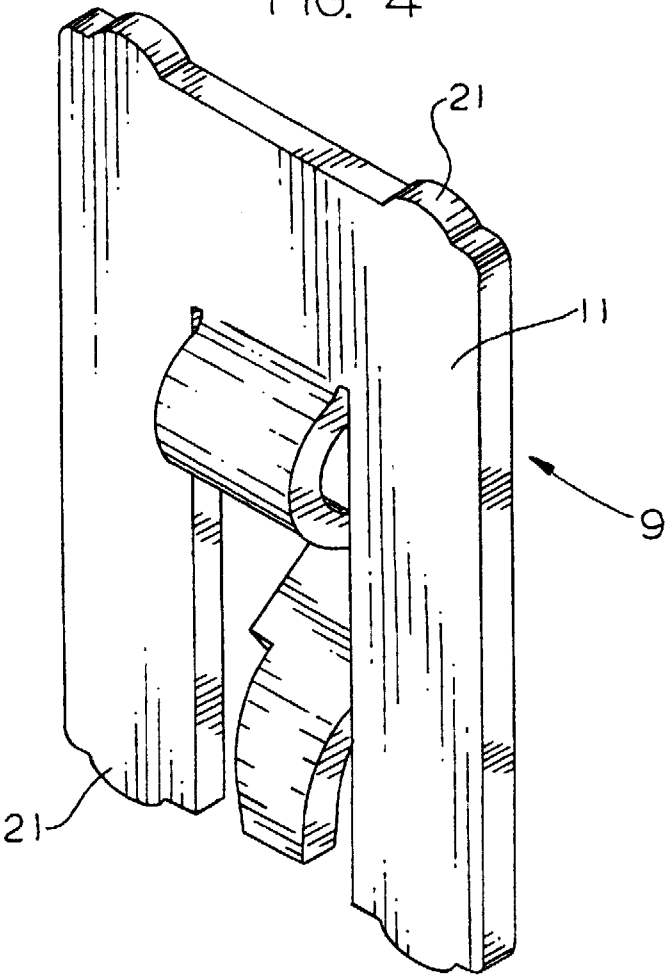
Figure 6:
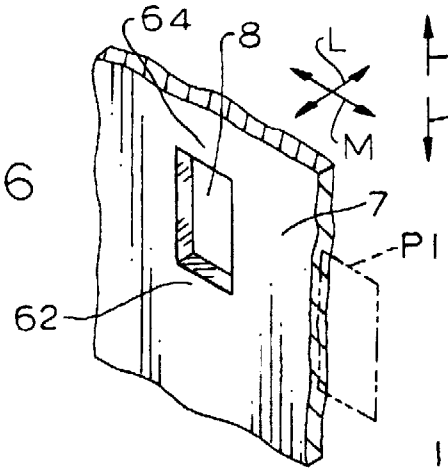
FIG. 6 is a likewise enlarged view of the cutout denoted in FIG. 1.
Figure 7:
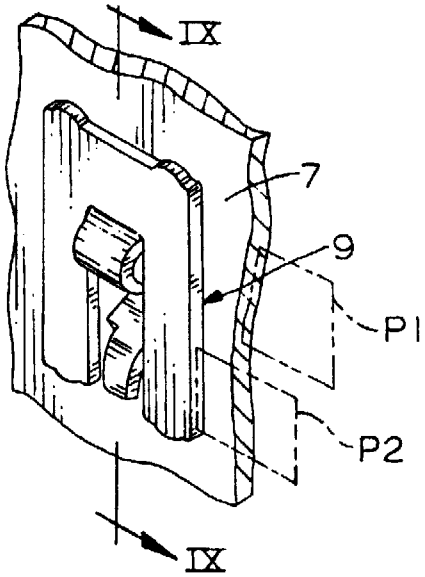
FIG. 7 is a combination of FIGS. 4 and 6.

FIGS. 1 and 2 show a connector system 30 that comprises a plug part or first connector 1 and a mating component or second connector 2. The connectors comprise first and second housings 32, 34 that each has laterally (L) opposite sides 40, 42. The connectors are mating by moving the first connector in a rearward direction R relative to the second connector, or by moving the second connector in a forward direction F relative to the first connector. In particular, this is a connector system for a mobile telephone. Here the plug part 1 is connected by means of a cable 3, and the mating component 2 is a so-called printed-board connector. The rear end of the plug part 1 facing away from the cable 3 represents a moulded component 4. It is inserted in the direction of the arrow R into the receptacle 5 of the mating component 2 or printed-board connector, respectively, which faces it, and to which it is locked in the inserted position. For this purpose, a cutout 8 is located at each of a pair of housing portions 7 that each lies at one of the first housing sides 40. As FIG. 6 shows, the cutout is rectangular, the long side of the rectangle extending in the direction of insertion. The housing portion 7 is in the form of a plate that lies approximately in a plane P1 that extends normal, or perpendicular, to the lateral direction L. Perpendicular to the plane of the paper in FIG. 2, at the left-hand and right-hand sides 42 in the region of the receptacle 5, a locking hook 9 is inserted into a housing slot 10, which, in this figure opens upwards and has a matching shape, so that the locking hook 9 is held in it in a clamping manner, for example. FIG. 3 shows fasteners 50 that fasten legs 52, 54 of the hook to the walls of the slot 10. FIGS. 4 and 5 show particularly clearly the precise shape of the locking hook, which basically consists of an, at least approximately, flat, basic element or mount portion 11 and a spring element or spring portion 12 preferably manufactured in one piece with said mount portion. The basic element 11 has an essentially U-shaped form. In FIGS. 4 and 5 it is flat, while in FIG. 9 a slight bead-like bulge 13 can be seen. This can improve the clamping action.

Figure 10:
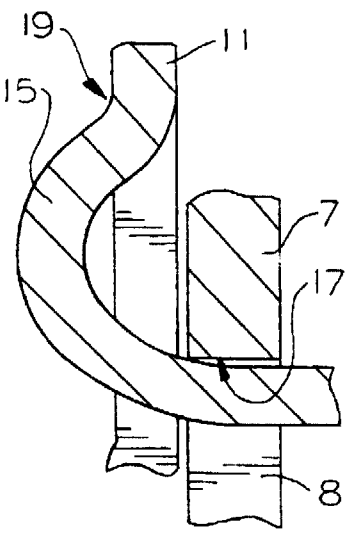
FIG. 10 is a more enlarged view of the cutout denoted in FIG. 9.
Figure 9:
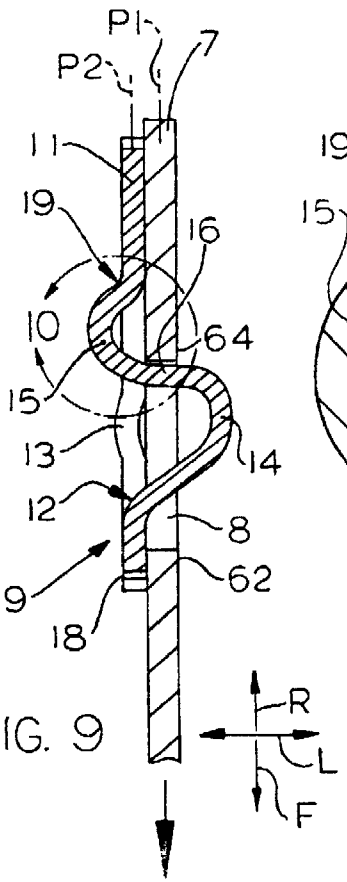
FIG. 9 is a slightly enlarged sectional view along the line IX—IX of FIG. 7.

The spring element 12 (FIG. 9) has a forward first arched section 14 and a rearward second arched section 15. As FIG. 9 shows, in the locked position of the plug part 1 and the mating component 2, the first arched section 14 penetrates the associated cutout 8. In the process the transition region 16 between the first and second arched section preferably makes contact with the upper lateral edge of the cutout 8, as shown in FIG. 9. As FIG. 10 shows in particular, this transition region runs perpendicular to the plane of the cutout or the narrow side first housing portion 7, respectively. It runs, at least approximately, in a straight line.

Figure 8:
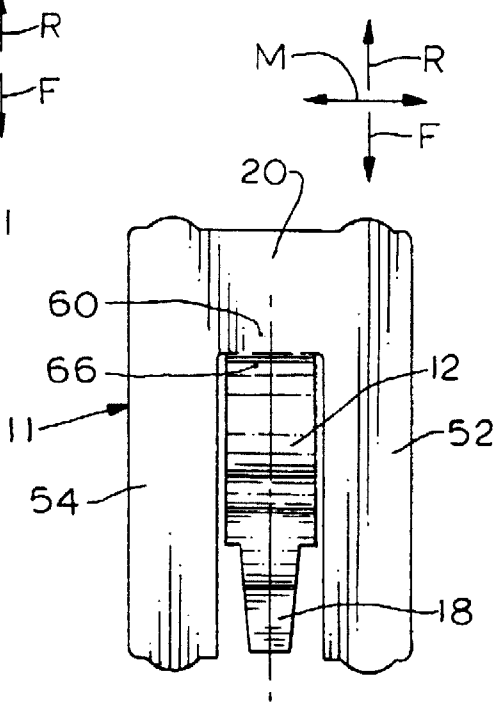
FIG. 8 is a plan view of the locking hook.

The spring element 12 has an essentially flat end piece 18, which has the shape of a tongue, and which adjoins the free end of the first arched section 14. In the unloaded state of the exemplary embodiment shown in FIG. 9, the end piece 18 lies in the plane P1 of the basic element or mount portion 11. Furthermore, it can be seen from FIG. 9 that the second arched section 15 merges into a type of groove 19 in the U-shaped centre web 20 of the essentially U-shaped basic element 11 of the locking hook 9 shown in FIG. 8. As is particularly clear from FIG. 4, the width of the flat or optionally slightly bent end piece 18 is less than the width of the rest of the spring element, the width being reduced in steps. The four bumps 21 at the upper and lower end of the basic element 11 (FIG. 4) provide backlash-free anchorable of the basic element in the housing slot 10. Are a matter of form, it should be pointed out that the two arched areas 14 and 15, together with the transition region 16, form an approximately S-shaped element, and according to FIG. 9, the first arched section 14 projects to the right and the second arched section 15 projects to the left beyond the plane (P2) of the U-shaped basic element. For preference, the first arched section 14 is larger than the second section 15.

The mount portion 11 (FIG. 8) of the locking hook 9, includes a central web 20 with a middle 60 that merges with the rear end 66 of the spring portion 12, with the central web having opposite sides that merge with the legs 52, 54 that extend forwardly therefrom. The legs 52, 54 lie on longitudinally (M) opposite sides of the spring portion 12. The mount portion 11 lies approximately in a plane P2 that is parallel to plane P1 of the housing portion 7. The arches 14, 15 project laterally beyond opposite sides of the plane P2. The plate-like housing portion 7 (FIG. 6) which lies in plane P1, has front and rear walls 62, 64 that lie respectively forward and rearward of the cutout 8. The front and rear walls 62, 64 are elongated in that they each have a length in directions F, R greater than their thickness.

We claim:

1. An electrical connector system that includes first and second connectors (1, 2) that can be mated by moving said second connector in a forward direction (F) relative to said first connector and that can be unmated by moving said second connector in a rearward direction (R), wherein said first and second connector have first and second housings (32, 34) that each have a pair of opposite sides (40, 42) spaced in first and second lateral directions (L) that are perpendicular to said forward direction, with said second connector having sheet metal locking hooks (9) at said second housing opposite sides and with said first connector having first housing portions (7) at said first housing opposite sides, with each of said first housing portions (7) being constructed to be held by one of said looking hooks when said connectors are mated, wherein:

each of said locking hooks comprises a mount portion (11) integrally formed from a corresponding one of said second housing sides, and each locking hook comprises a spring portion (12) having a rear end (66) integral with said mount portion, said spring portion having a free front end (18) with said spring portion being bent to form a rear curved arch (15) that projects in said first lateral direction and to form a front curved arch (14) that projects in said second lateral direction which is opposite to said first lateral direction, with said arches together forming an approximately S-shape;

each of said first housing portions (7) is in the form of a sheet metal plate that lies approximately in a plane P1 that is normal to said lateral direction, said plate having a cutout (8) that receives said front curved arch of said spring portion with said cutout lying forward of an elongated rear wall (64) of said housing portion that is elongated in said forward and rearward directions;

said plate of said first housing portion (7) having a front wall (62) lying forward of said cutout and said free front end (18) of said spring portion rests against said front wall.

2. The electrical connector described in claim 1 wherein:

said mount portion is of approximately U-shape, with a center web (20) having a middle (60) and having opposite sides and with a pair of legs (52, 54) each extending forwardly from a different one of said opposite sides and lying at opposite sides of said spring portion.

3. A locking hook for mounting on a second electrical connector to lock the second connector to a first electrical connector that has a side plate with a cutout, so the first connector can mate with the second electrical connector, comprising:

a sheet metal plate-like mount that lies approximately in a plane (P2) and that has a web with a middle and with opposite sides;

a strip-shaped sheet metal spring portion having a rear end that is integrally formed with said middle of said web, said spring portion being bent to form a rear curved arch (15) projecting in a first upward lateral direction beyond said plane end to form a front curved arch (14) lying forward of said rear arch with said front arch projecting in a second downward lateral direction opposite to said first lateral direction, beyond said plane to enter said cutout of said side plate, said arches together forming an approximately S shape;

said plate-like mount having a pair of legs extending forwardly from said web on said opposite sides thereof and lying on opposite ides of said spring portion;

said spring portion having a front end (18) lying laterally between said rear and front arches, so said front end can rest against said side plate.

* * * * *